US005877132A

United States Patent [19]

Callaghan et al.

[11] Patent Number: 5,877,132

[45] Date of Patent: Mar. 2, 1999

[54] CLEANING COMPOSITIONS

[75] Inventors: Ian C. Callaghan, Wokingham; Grace Abamba, London; Robert Kinsley, Windlesham; Timothy I. Moodycliffe, Sunbury-On-Thames, all of United Kingdom; Richard P. Woodbury, Amherst, N.H.

[73] Assignee: S. C. Johnson & Son, Inc., Racine, Wis.

[21] Appl. No.: 969,833

[22] Filed: Nov. 13, 1997

Related U.S. Application Data

[63] Continuation of Ser. No. 548,571, Oct. 26, 1995, abandoned.

[51] Int. Cl.[6] ..... C11D 1/06

[52] U.S. Cl. ..... 510/114; 510/434; 510/488; 510/489; 510/479; 510/506

[58] Field of Search ..... 510/114, 191, 510/434, 488, 489, 506, 479

[56] References Cited

U.S. PATENT DOCUMENTS

| | | | |
|---|---|---|---|
| 3,635,830 | 1/1972 | Lamberti et al. | 252/152 |
| 3,692,685 | 9/1972 | Lamberti et al. | 252/89 |
| 3,914,297 | 10/1975 | Lamberti et al. | 260/535 P |
| 3,954,858 | 5/1976 | Lamberti et al. | 260/535 P |
| 4,663,071 | 5/1987 | Bush et al. | 252/174.19 |
| 5,061,393 | 10/1991 | Linares et al. | 252/143 |
| 5,174,927 | 12/1992 | Honsa | 252/543 |
| 5,238,843 | 8/1993 | Carpenter et al. | 435/264 |
| 5,332,528 | 7/1994 | Pan et al. | 252/548 |

FOREIGN PATENT DOCUMENTS 857837 12/1970 Canada .

*Primary Examiner*—Paul Lieberman
*Assistant Examiner*—John R. Hardee
*Attorney, Agent, or Firm*—Laura L. Bozek

[57] ABSTRACT

A range of novel biodegradable aqueous acid cleaning systems for removing limescale from surfaces, especially stainless steel and porcelain surfaces, wherein said system comprises a biodegradable aqueous acid system, said system having a pH of less than 7.0, said system comprising at least one of the following acids:

i) iminodiacetic acid;

ii) aspartic acid;

iii) derivatives selected from N-alkyl, N-alkylaryl and N-cycloaliphatic derivatives of iminodiacetic acid;

iv) derivatives selected from N-alkyl, N-alkylaryl and N-cycloaliphatic derivatives of aspartic acid; and v) $C_2$–$C_{10}$ polycarboxylic acids, said polycarboxylic acids containing a heteroatom in the main chain thereof, said heteroatom being selected from S, O and N; said system optionally comprising mixtures of said acids (i) to (v).

The composition preferably comprises a surfactant to optimize the performance of said acid. Additional optional ingredients are selected from thickeners and co-builders and enzyme mixtures. There is also provided a method of removing limescale from surfaces employing such compositions.

16 Claims, No Drawings

CLEANING COMPOSITIONS

This application is a continuation of application Ser. No. 08/548,571 filed Oct. 26, 1995, now abandoned.

TECHNICAL FIELD

This invention relates to cleaning compositions particularly for use in removing limescale stains from surfaces.

BACKGROUND ART

In the art the term "scale" has been used inconsistently depending on the particular art which is being considered. For example, the dentist would probably associate the word "scale" with plaque (i.e. organic material) adhered to teeth. On the other hand the detergent chemist would probably associate the term "scale" with "soap scum", that is to say insoluble calcium salts of soaps. However, in the particular cleaning composition art with which the subject invention is concerned, scale means limescale. As used herein limescale means insoluble metal salts, which salts have effectively zero solubility in water. Limescale is usually formed from insoluble salts such as magnesium carbonate, magnesium sulfate, calcium carbonate, calcium sulfate and mixtures thereof.

As is well known in the art, limescale can accumulate as a solid water insoluble deposit in places which come into contact with water, for example around the bases of hot and cold water taps in the bathroom and in the kitchen and inside the toilet bowl. The mentioned deposits once deposited are difficult to remove without damaging the relevant surface, for example the toilet bowl, the taps, the sink, bath or basin.

Difficulties with the depositing of limescale are more likely to occur in hard water areas rather than soft water areas. Hard water contains finely divided quantities of calcium sulphates and carbonates which can react to be deposited as limescale on the relevant surfaces.

Compositions for removing limescale usually act by dissolving away the insoluble limescale stain. Since the resulting solution is usually washed into the domestic drainage system, and from the domestic drainage system through the usual water treatment plants, and ultimately into rivers and into the sea, it is accordingly desirable that acid limescale removing compositions and the salts thereof, whether in solution or out of solution, should be biodegradable.

Many limescale removers are known in the art. Early limescale removers were formulations comprising aqueous hydrochloric acid. Subsequently there were formulations comprising organic acids, said organic acids usually being $C_1$–$C_5$ acids, for example citric acid and maleic acid.

One bathroom cleaner and limescale remover known in the art is sold under the tradename "OzÔ". It is stated to be ideal for plastic and enamel baths, sinks, taps and tiles.

A good limescale remover will have the following advantages:

1. It will be safe. More specifically, a cleaning composition is likely to come into contact with human skin, and might even come into contact with eyes. Thus, it is important that such skin or eye contact causes minimum discomfort and no lasting damage.
2. It will be fast-acting. Depending on the extent of the limescale stain, it is usually necessary to leave the limescale remover in contact with the stain for a short time. Usually, even with a small degree of staining, limescale removers do not remove the stain instantaneously. Good limescale removers would also be sufficiently viscous such that the composition will remain in contact with the limescale stain, for example around a tap base, rather than running away, but on the other hand, not too viscous such that they cannot be applied evenly and easily.
3. A good limescale remover will ideally be biodegradable as mentioned above.
4. A good limescale will, again as mentioned above, be safe for use in the toilet bowl, on taps and other surfaces without causing damage thereto. It may be necessary to use a limescale remover on such surfaces as porcelain, plastic, enamel, iron, stainless steel and plated surfaces. It is important that the scale remover should not damage any of these substrates, and in particular should not etch enamels or plated surfaces.

The compositions of the subject invention have all the advantages listed under paragraphs 1–4 above, and furthermore are preferably at least twice as efficient, or more preferably five times as efficient as similar compositions comprising citric acid while maintaining a very similar pH to the citric acid composition. If the composition is too acidic, then the composition is likely to be less safe. The efficiency of the various compositions for cleaning is determined in accordance with the "marble cube test", details of which are set out below.

DESCRIPTION OF THE INVENTION

Accordingly to one embodiment of the subject invention there is provided a biodegradable aqueous acid cleaning composition, said composition having a pH less than 7.0, said composition comprising at least one acid selected from acids having either general formula (1) or general formula (2):

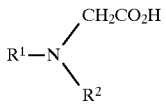

(1)

wherein:

$R^1$ independently can be selected from H, alkyl alkylaryl, $—(CH_2)_nCO_2H$, $—CH((CH_2)_mCO_2H)_2$ and $—CH(CO_2H)—(CH_2)_pCOOH$;

$R^2$ independently can be selected from $—CH_2CO_2H$, alkyl, alkylaryl and $—CH(CO_2H)—(CH_2)_pCO_2H$; and $$R^3—X—(CH_2)_nCO_2H \quad (2)$$

where

X independently can be selected from O and S;

$R^3$ independently can be selected from $—(CH_2)_nCO_2H$, $—CH[(CH_2)_mCO_2H]_2$, $HO_2C—CH—CH_2CO_2H$, and $—CH(CO_2H)—(CH_2)_pCO_2H$ where n, m and p are in the range 1–8. Optionally mixtures of said acids can be used.

According to another embodiment of the subject invention there is provided a biodegradable aqueous acid cleaning composition, said composition having a pH less than 7.0, said composition comprising at least one of the following acids:

i) iminodiacetic acid;

ii) aspartic acid;

iii) derivatives selected from N-alkyl, N-alkylaryl and N-cycloaliphatic derivatives of iminodiacetic acid;

iv) derivatives selected from N-alkyl, N-alkylaryl and N-cycloaliphatic derivatives of aspartic acid; and v) $C_2$–$C_{10}$ polycarboxylic acids, said polycarboxylic acids containing a heteroatom in the main chain thereof, said heteroatom being selected from S, O and N; said composition optionally comprising mixtures of said acids (i) to (v).

Preferably the above compositions when tested by the marble cube test, gives a percentage weight loss of at least twice that of a citric acid composition, said compositions and said citric acid composition comprising 5% by weight acid.

According to another embodiment there is provided a method of cleaning limescale from surfaces, preferably either stainless steel or porcelain surfaces (e.g. the surface of the toilet bowl), which comprises applying the above-described compositions to said surface.

The acids identified above react with water insoluble limescale to form a water soluble salt which reaction allows for the removal of the limescale, without damage to the surfaces to which the limescale was attached.

The cleaning composition of the subject application shows all the advantages of a good limescale remover set out and above; and in particular is fast acting.

In use, preferred compositions of the subject invention show dissolution times against limescale of at least 10 seconds, more preferably of between 10 seconds and 30 minutes, even more preferably of between 10 seconds and 15 minutes, yet even more preferably of between 10 seconds and five minutes.

All amounts stated in this description are based on the total weight of the composition of the invention.

MODES OF CARRYING OUT THE INVENTION

The acids used in the composition of the invention are those listed below. As mentioned, they need to be soluble in aqueous solution, and this requirement for solubility will determine the extent to which there can be substitution; and the type of substituents that are permitted.

As mentioned, the compositions of the invention can comprise at least one acid selected from:

i) iminodiacetic acid;

ii) aspartic acid;

iii) derivatives selected from N-alkyl, N-alkylaryl and N-cycloaliphatic derivatives of iminodiacetic acid;

iv) derivatives selected from N-alkyl, N-alkylaryl and N-cycloaliphatic derivatives of aspartic acid; and v) certain $C_2$–$C_{10}$ polycarboxylic acids.

vi) acids having either general formula (1) or general formula (2):

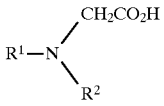

(1)

wherein:

$R^1$ independently can be selected from H, alkyl, alkylaryl, $—(CH_2)_nCO_2H$, $—CH((CH_2)_mCO_2H)_2$ and $—CH(CO_2H)—(CH_2)_pCOOH$;

$R^2$ independently can be selected from $—CH_2CO_2H$, alkyl, alkylaryl and $—CH(CO_2H)—(CH_2)_pCO_2H$; and $$R^3—X—(CH_2)_nCO_2H \quad (2)$$

where

X independently can be selected from O and S;

$R^3$ independently can be selected from $—(CH_2)_nCO_2H$, $—CH[(CH_2)_mCO_2H]_2$, $HO_2C—CH—CH_2CO_2H$, and $—CH(CO_2H)—(CH_2)_pCO_2H$ where n, m and p are in the range 1–8.

Iminodiacetic acid is

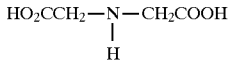

The substituted derivatives thereof which can be used in the invention are selected from N-alkyl, N-alkylaryl and N-cycloaliphatic derivatives.

The substituents themselves can be further substituted.

Aspartic acid is

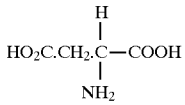

The substituted derivatives of aspartic acid which can be used in the composition of the subject invention are selected from N-alkyl, N-alkylaryl and N-cycloaliphatic derivatives. The preferred ranges for the substituents of said derivatives of aspartic acid, said derivatives iminodiacetic acid and said acids of general formula (1) and (2) are:

H and alkyl: H; $C_1$ to $C_{10}$ alkyl aryl: $C_6$ to $C_{14}$ cycloaliphatic: alkylcyclohexyl or alkylcyclopentyl with alkyl range of $C_5$ to $C_{14}$.

The substituents themselves can be further substituted.

Short chain of chain length $C_2$–$C_{10}$ polycarboxylic acids containing a heteroatom in the main chain thereof, said heteroatom being selected from S, O and N can be selected from the following:

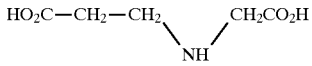

(1)

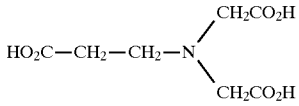

(2)

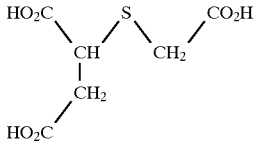

(3)

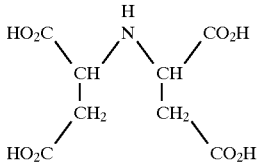

(4)

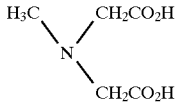

(5)

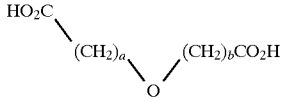

(6)

$1 \leqq a, b \leqq 10$

Preferably the acids are present in an amount of from 1 to 15 weight percent.

Preferred compositions of the subject invention will also comprise a surfactant, said surfactant being selected from a nonionic surfactant and an anionic surfactant (or mixtures thereof) preferably being a nonionic surfactant. More preferably the surfactant will be stable in acid. Preferred surfactants are selected from alkyl betaines, alkyl polyglycosides, amine oxides, the alkyl phenol ethoxylates, alkyl ethoxylates and all the fatty alcohol ethoxylates.

Most preferably the surfactants will have a HLB value in the range 10 to 14.

Typically said surfactants will be present in an amount of 0.05 weight percent to 10 weight percent.

Preferred compositions of the subject invention comprising a surfactant will have a faster action against limescale. The surfactant assists the composition to wet and penetrate the limescale stains to be removed. Preferred surfactants for use in the subject invention have an HLB in the range 10–14 as mentioned. More preferably, the surfactants will have an HLB in the range of about 10.5–12.

The HLB (hydrophile-lipophile balance) is a measure of the relative water solubility of the surfactant and gives an indication of the relative proportions of hydrophobic and hydrophillic portions in the molecule. It is a known parameter used by emulsion chemists to select emulsifiers.

It is also desirable that a co-builder be present, partly to assist in avoiding salting-out of these surfactants. A wide variety of co-builders are used with surfactants, especially with anionic surfactants in the various applications of known surfactants. Preferred co-builders that are useful in the composition of the subject invention are alkali metal polyphosphates, alkali metal salts of organic acids, organic phosphates and alkali metal salts of water soluble polymeric acids.

More preferably the co-builder is at least one of STPP (sodium tripolyphosphate), an alkali metal salt of citric acid, an alkali metal salt of lactic acid, an alkali metal salt of sulphamic acid, an alkali metal salt of gluconic acid, an alkali metal salt of polyacrylic acid and an alkali metal salt of modified polyacrylic acid. Mixtures of the above mentioned co-builders can be utilized. A commercially available cobuilder is Sokalan DCSÔ comprising a mixture of acid salts. More preferably the co-builder is present in an amount of 0.5–12 percent by weight.

The cleaning composition of the invention preferably comprises an enzyme mixture.

Ideally the enzymes should be present in minor amounts. Without being bound by theory, it is believed that the enzymes assist to prevent reemergence of limescale following treatment with the composition of the subject invention by combating biofilm formation. Limescale tends to form more easily on surfaces already contaminated with, inter alia, bacteria and fungi; and ideally the enzymes should be selected from those which, following treatment of the surface with the composition of the subject invention are effective to prevent reappearance of colonies of bacteria and fungi. It is of course possible that the enzyme could be used for this purpose in other known limescale removing compositions. Preferably the cleaning composition of the invention comprises an enzyme mixture, wherein said enzyme mixture comprises carbohydrase and gluconase enzymes. Carbohydrase enzymes are those enzymes which catalyse the hydrolysis of carbohydrate polymers, including disaccharides to respectively smaller polymers and monosaccharides.

Glucanase enzymes are those enzymes which catalyze the breakdown of glucan. Glucan is a polysaccharide composed of the hexose, sugar, d-glucose.

Preferably the enzymes in said enzyme composition or said enzyme mixture are active in the pH range 2 to 5 and are capable of catalyzing the breakdown of sugar based biopolymers. A variety of carbohydrases and glucanases are available commercially. Preferred carbohydrases and glucanases are manufactured by Novo Nordisk Industry under the tradename VISCOZYME®. Similar enzymes from other commercial sources would be equally acceptable.

Preferably the enzymes are each present in an amount of 0.1 weight percent to 4 weight percent.

Since the compositions of the invention are generally intended for removing limescale stains, they should be of sufficient viscosity to enable them to be held on the limescale stain for an effective time, i.e. for sufficient time to effect removal of the limescale stain. It may be necessary to add a thickener for this purpose. However, any added thickener should not be present in so high an amount such that there is detraction from the ability of the cleaning composition to wet and penetrate the stain, or such that the cleaning composition becomes difficult to apply evenly.

The amount of the thickener will depend on the nature of the thickener and the other components in the composition, and it may be that the other components in the composition, in addition to the other properties, also act as the thickener for the purpose of giving the appropriate viscosity to the composition. The thickener, when present, should be present in the range of 0.2–6 weight percent.

The thickeners can be organic polymeric materials; inorganic compounds or mixtures thereof. Suitable organic polymeric thickeners are selected from at least one of a biopolymer, a cross-linked polyacrylate, and a modified polyacrylate, or mixtures thereof. The said biopolymers can be xanthan or whelan gum. The said crosslinked polyacrylate, for example, can be those commercially available in the CARBOPOL® Series produced by B. F. Goodrich. The said modified polyacrylate can be, for example, those commercially available in the NARLEX® Series produced by National Starch. When thickeners are selected from the NARLEX® Series, then it is preferred that the NARLEX® thickener is used in combination with a nonionic surfactant to achieve optimum thickening effect.

Suitable inorganic thickeners are selected from at least one of smectite clay, synthetic hectolite, alumino-silicate and attapulgite.

The compositions of the invention can contain other components which do not necessarily materially effect the properties of the system but are conventionally found in cleaning compositions, for example, sequestering agents, dyes, bleaches, bleach activators, foam control agents and fragrances.

The cleaning composition of the invention is an aqueous cleaning composition. However, other diluents apart from water can be present, and the amount of water present can vary. Generally the composition of the invention will contain appropriate diluents for application as such, although the composition could be prepared in concentrated form for dilution prior to use. As mentioned, the preferred diluent is water and will usually comprise at least 60 percent, preferably at least 90 percent by weight of the composition.

Particularly where the area of toilet care is concerned, it is conventional to provide aqueous cleaning compositions in concentrated or even super-concentrated form; more preferably in the form of a slow release gel formulation. In one preferred embodiment the slow release gel formulation is placed in the cistern of the toilet. The composition of the invention releases slowly into the water filled cistern at an effective rate such that the water in the cistern comprises an effective concentration of the composition of the invention. When the toilet flushes, the toilet bowl is washed with the composition of the invention. In an alternative preferred embodiment, the slow release gel formulation can be placed again in a suitable container within the toilet bowl. The container is usually clipped to the side of the toilet bowl such that when the toilet is flushed, the water flows over the composition of the invention as it passes into the toilet bowl. As a result the toilet bowl is washed with an effective concentration of the aqueous cleaning composition of the invention.

The composition of the invention can also be applied directly, for example by pouring or indirectly by means of brushing, by means of a damp cloth, or by spraying on from a spray device including an aerosol dispenser. In the case of an aerosol dispenser the foaming agent present in the composition will result in a foam which covers the surface to be treated.

Preferably the composition will comprise the following components in the following amounts:

i) said acid in an amount of 1 weight percent to 15 weight percent;

ii) said enzyme wherein each enzyme is present in an amount of 0.1 weight percent to 4 weight percent;

iii) said thickener in an amount of 0.2 weight percent to 6 weight percent;

iv) said surfactant in an amount of 0.05 weight percent to 10 weight percent;

v) said cobuilder in an amount of 0.5 weight percent to 12 weight percent;

vi) effective amounts of ingredients selected from sequestering agents, dyes, bleaches, bleach activators, foam control agents and fragrances; and vii) balance water.

As mentioned above, cobuilders can be present as optional ingredients in the composition of the subject invention.

Also as mentioned above, those skilled in the art of detergents have prepared detergents which include cobuilders. Cobuilders in detergent compositions are effective for preventing, in areas of hard water, the production of soap scum. Soap scum is prepared when calcium ions present in hard water react with the soap to form an insoluble "scum". Examples of suitable cobuilders are set out above, and in all cases are salts of strong base plus weak acids such that there would be formed aqueous compositions comprising cobuilder with an alkali pH, i.e. with a pH greater than 7. In detergent compositions it is believed that the cobuilder prevents the production of scum by virtue of having a higher affinity for calcium ions than does the soap molecule. Thus there is a competitive reaction between cobuilder molecule and soap molecule for reaction with calcium ion, and the calcium ion reacts preferentially with the cobuilder rather than with the soap by reason of the higher affinity of the calcium ion with the cobuilder molecule. The cobuilder chelates the calcium ion, thereby removing the calcium ion from the reaction system.

It is conventional in the detergent art that the chelating ability of various cobuilder molecules for various ions, especially calcium ions, are measured quantitatively in accordance with a standard test measurement.

The chelation reactions discussed above can be considered as a subclass of complex formation reactions. The tendency of a reaction system to form complexes is quantitatively measured by the overall stability constant $'\beta_n$.

The conditional overall stability constant of the complex $BA_n$ is given by $$\beta'_n = \frac{[BA_n]}{[B'][A']^n}$$

where [B'] is the total concentration of central group not bound to A, and [A'] is the total concentration of ligand not bound to B. If B is a metal ion and A an organic ligand, the two series of complexes $B(OH)_n$ and $H_jA$ will probably exist in aqueous solution in addition to the species $BA_n$. If no other complexes are formed, then $$[B'] = B - \sum_1^N [BA_n] = \sum_0^N [B\,(OH)_n]$$

and $$[A'] = A - \sum_0^N n[BA_n] = \sum_0^J [H_jA]$$

where B and A are the total concentrations of central group and ligand, respectively. Thus, $\beta'_n$ is a function of the hydrogen ion concentration. If a buffer solution is used, [B'] must also include any complexes formed between B and the buffer species. The conditional stability constant will then depend on the concentration of buffer as well as on the pH.

The definitions given above are restricted to simple mononuclear species, i.e. to species that contain only one central group per complex and only one type of ligand. The overall stoichiometric stability constant of a mixed mononuclear complex $BA_nU_n$ containing two types of ligand, A and U, is defined as $$\beta_{1nn} = \frac{[BA_nU_n]}{[B][A]^n[U]^n}$$

The overall stoichiometric stability constant of the polynuclear complex $B_qA_p$ may be defined analogously as $$\beta_{qp} \frac{[B_qA_q]}{[B]^q[A]^p}$$

Overall equilibria for the formation of mixed or polynuclear complexes can be subdivided into a number of step reactions, each with an appropriate step stability constant.

It is surprisingly been found that the acids used in the compositions of the subject invention have a higher chelating ability as measured as set out above than do similar compositions known in the art, comprising for example citric acid. The chelating ability must of course be measured in the actual system in which the chelation takes place and it is not sufficient to reply on figures derived from standard tables which are usually measured in distilled water. Without wishing to be bound by theory it is believed that it is partly for this reason that the cleaning compositions of the subject invention are so much more effective than known cleaning compositions comprising, for example citric acid; while at the same time the cleaning compositions of the invention work at approximately the same pH as do similar cleaning compositions comprising citric acid. Preferably the acids used in the compositions of the subject invention will chelate calcium ions better than does citric acid.

Further information on the measurement of stability constants can be found in the publication F. J. C. Rossotti and H. Rossotti, "The Determination of Stability Constants," McGraw-Hill, New York (1960).

EXPERIMENTAL

The method used to assess the efficiency of the biodegradable acids is the "marble cube test".

A marble cube weighing approximately 20 g is washed with tap water, dried to remove excess water and then placed in a drying oven overnight. The cube is then cooled and re-weighed ($W_0$).

150 g of the product under test is then weighed into a tared conical flask and a marble cube then placed in the flask. The flask is then left for 18 hours and the cube is then removed, rinsed, oven dried re-weighed ($W_1$).

The % weight loss is then given by:

$$\left(\frac{W_0 - W_1}{W_0}\right) \times 100$$

The determinations are performed in triplicate.

EXAMPLE 1

N.B. Citric Acid Used as a Benchmark

| ACID | Viscozyme (ex Novo) | Narlex TD10 (ex Nat. Starch) | Synperonic A7 (ex ICI) | Deionized Water |
|---|---|---|---|---|
| 1. CITRIC (5%) | 1% | 2.5% | 5% | 86.5% |
| 2. CITRIC (10%) | 1% | 2.5% | 5% | 81.5% |
| 3. N-methyIDA (5%) | 1% | 2.5% | 5% | 86.5% |
| 4. N-methyIDA (10%) | 1% | 2.5% | 5% | 81.5% |
| 5. BCMS (5%) | 1% | 2.5% | 5% | 86.5% |
| 6. BCMS (10%) | 1% | 2.5% | 5% | 81.5% |

N.B. BCMS = but-1,4-dicarboxyl carboxymethylsulphide
N-methyl = N-methyl iminodiacetic acid

Results

N.B. Citric Acid (5%) Rel % wt. loss=1

| Formulation | Rel % wt. loss |
|---|---|
| 1 | 1.00 |
| 2 | 2.24 |
| 3 | 2.26 |
| 4 | 3.40 |
| 5 | 2.71 |
| 6 | 5.27 |

INDUSTRIAL APPLICABILITY

The above-described biodegradable aqueous cleaning compositions of the invention may be manufactured via conventional for aqueous cleaning compositions. The compositions are useful in removing limescale from a variety of surfaces, especially stainless steel and porcelain surfaces. In addition, the compositions of the present invention may be dispensed from a wide-variety of dispensing means. For example, the composition may be applied directly to a surface by pouring, or indirectly by means of spraying on by an aerosol container or trigger sprayer.

We claim:

1. A biodegradable aqueous acid cleaning composition, said composition comprising (A) at least one acid selected from the group consisting of acids having general formula (2):

$$R^3—X—(CH_2)_nCO_2H \quad (2)$$

where

X independently can be selected from O and S;

R independently can be selected from $—(CH_2)_nCO_2H$, $—CH[(CH_2)_mCO_2H]_2$, $HO_2C—CH—CH_2CO_2H$, and $—CH(CO_2H)—(CH_2)_pCO_2H$ where n, m and p are in the range 1–8;

(B) from 0.2 weight percent to 6 weight percent based on the total weight of said composition of a thickener selected from the group consisting of biopolymers, crosslinked polyacrylate, modified polyacrylates, and mixtures thereof; and (C) an enzyme mixture containing enzymes selected from the group consisting of carbohydrase, gluconase and mixtures thereof, wherein said composition has a pH of 0.1–5.

2. A biodegradable aqueous acid cleaning composition comprising (A) At least one acid selected from the group consisting of polycarboxylic acids containing a heteroatom in the main chain thereof, said polycarboxylic acids selected from the group consisting of $HO_2C—(CH_2)_a—O—(CH_2)_b—CO_2H$, wherein a and b are both integers having a value of at least 1, and the total of a and b is not greater than 10;

(B) from 0.2 weight percent to 6 weight percent based on the total weight of said composition of a thickener selected from the group consisting of biopolymers, crosslinked polyacrylate, modified polyacrylates, and mixtures thereof; and © an enzyme mixture containing enzymes selected from the group consisting of carbohydrase, gluconase and mixtures thereof; wherein said composition has a pH of 0.1–5.

3. The cleaning composition of claim 1 or 2 having an acid concentration of about 5% by weight, which, when tested by a marble cube test, gives a percentage weight loss of at least twice that of a citric acid composition, said composition and said citric acid composition comprising about 1% by weight of the enzyme mixture, about 2.5% by weight of the thickener, about 5% by weight of a nonionic surfactant about 5% by weight of citric acid, and the balance water.

4. The cleaning composition of claim 1, wherein said acid is present in an amount of from 1 weight percent to 15 weight percent based on the total weight of the composition.

5. The cleaning composition of claim 1 further comprising a surfactant selected from the group consisting of nonionic surfactants, anionic surfactants, and mixtures thereof.

6. The cleaning composition of claim 5, wherein said surfactant has a HLB in the range above 12.

7. The cleaning composition of claim 5, wherein said surfactant is stable in acid.

8. The cleaning composition of claim 5, wherein the surfactant is a nonionic surfactant is selected from the group consisting of alkylethoxylates and alkylphenylethoxylates.

9. The cleaning composition of claim 5, wherein said surfactants are present in an amount of 0.05 weight percent to 10 weight percent based on the total weight of the composition.

10. The cleaning composition of claim 1, further comprising a cobuilder.

11. The cleaning composition of claim 10, wherein said cobuilder is selected from the group consisting of an alkaline metal polyphosphate; an alkaline metal salt of an organic acid; an organic phosphonate; an alkaline metal salt of a water soluble polymeric acid and derivatives thereof; and mixtures thereof.

12. The cleaning composition of claim 11, wherein said organic acid is selected from the group consisting of citric acid and gluconic acid.

13. The cleaning composition of claim 11, wherein said polymeric acid is selected from the group consisting of polyacrylic acid and modified polyacrylic acid.

14. The cleaning composition of claim 10, wherein said cobuilder is present in an amount of 0.5 weight percent to 12 weight percent, based on the total weight of said composition.

15. The cleaning composition of claim 1, wherein said biopolymer is selected from the group consisting of xanthan and whelan gum.

16. The cleaning composition of claim 1 wherein said thickener is a modified polyacrylate; and wherein said composition further comprises a nonionic surfactant.

* * * * *